US005722128A

United States Patent [19]

Toney et al.

[11] Patent Number: 5,722,128

[45] Date of Patent: Mar. 3, 1998

[54] FASTENER ASSEMBLY WITH SLIDER PROVIDING TACTILE AND/OR AUDIBLE FEEDBACK

[75] Inventors: Kenneth A. Toney; Jose Porchia, both of Midland; Brian C. Dais, Sanford, all of Mich.

[73] Assignee: Dow Brands Inc., Indianapolis, Ind.

[21] Appl. No.: 740,801

[22] Filed: Nov. 4, 1996

[51] Int. Cl.[6] ..... A44B 1/04

[52] U.S. Cl. ..... 24/400; 383/63; 24/587; 24/399; 24/577

[58] Field of Search ..... 24/381, 399–403, 24/575–577, 587, 437; 383/63, 65

[56] References Cited

U.S. PATENT DOCUMENTS

| | | | |
|---|---|---|---|
| 1,703,712 | 2/1929 | Aud | 24/400 X |
| 3,054,434 | 9/1962 | Ausnit et al. | 24/399 X |
| 3,122,807 | 3/1964 | Ausnit . | |
| 3,173,184 | 3/1965 | Ausnit | 24/587 |
| 3,426,396 | 2/1969 | LaGjerre . | |
| 4,262,395 | 4/1981 | Kosky | 24/400 |
| 4,731,911 | 3/1988 | Gould | 24/587 |
| 5,007,143 | 4/1991 | Herrington | 24/400 |
| 5,020,194 | 6/1991 | Herrington et al. . | |
| 5,063,644 | 11/1991 | Herrington et al. | 24/400 |
| 5,067,208 | 11/1991 | Herrington, Jr. et al. | 24/400 |
| 5,070,584 | 12/1991 | Dais et al. | 24/400 X |
| 5,138,750 | 8/1992 | Gundlach et al. | 24/587 |
| 5,140,727 | 8/1992 | Dais et al. | 24/587 |
| 5,248,201 | 9/1993 | Kettner et al. | 383/63 |
| 5,301,394 | 4/1994 | Richardson et al. | 24/399 |
| 5,301,395 | 4/1994 | Richardson et al. . | |
| 5,363,540 | 11/1994 | Dais et al. | 24/400 X |
| 5,403,094 | 4/1995 | Tomic | 24/587 X |
| 5,442,837 | 8/1995 | Morgan | 24/400 |
| 5,442,838 | 8/1995 | Richardson et al. . | |
| 5,448,808 | 9/1995 | Gross | 24/400 |

*Primary Examiner*—Peter M. Cuomo
*Assistant Examiner*—Robert J. Sandy

[57] ABSTRACT

A reclosable fastener assembly with a slider for closing and opening a thermoplastic bag, including alternating deformed and undeformed segments disposed along the length of the fastener in order to provide a tactile and/or audible sensation as the slider moves across the fastener.

14 Claims, 5 Drawing Sheets

FASTENER ASSEMBLY WITH SLIDER PROVIDING TACTILE AND/OR AUDIBLE FEEDBACK

BACKGROUND OF THE INVENTION

Reclosable fastener assemblies are useful for sealing thermoplastic bags. Such fastener assemblies often include a plastic zipper and a slider. Typically, the plastic zippers include a pair of interlockable fastener elements, or profiles, that form a closure. As the slider moves across the profiles, the profiles are opened or closed.

The profiles in plastic zippers can take on various configurations. For example, U.S. Pat. No. 5,140,727 describes interlocking rib and groove elements, whereas U.S. Pat. No. 5,007,143 describes a rolling action zipper profile, and U.S. Pat. No. 3,173,184 describes profiles that have alternating hook-shaped closure elements.

The sliders for opening or closing the reclosable fasteners are generally shaped so that the slider straddles the profiles. The sliders often include a separating element that is either inserted through the profiles in order to open the fastener, as described in U.S. Pat. No. 4,262,395, or slides above the profiles between specially adapted tracks, as described in U.S. Pat. No. 5,007,143.

The separating elements on the sliders have various shapes. For example, U.S. Pat. No. 3,173,184 describes a V-shaded separating element, while U.S. Pat. No. 5,067,208 describes a tapered separating element with a circular end.

It would be an advance in the art of reclosable fastener assemblies if a plastic zipper with a slider could be developed which would provide tactile and/or audible feedback in addition to visual feedback as the slider is moved across the zipper.

SUMMARY OF THE INVENTION

The present invention provides a user of a reclosable plastic bag with audible and/or tactile feedback in addition to visual feedback to indicate to the user that the slider is moving across the profiles.

The present invention is a reclosable fastener assembly for closing and opening a thermoplastic bag, the fastener assembly comprising four elements. The first element is a first profile having an inner surface, an outer surface, and a top edge, the first profile including at least one closure element positioned along the length of the inner surface. The second element is a second profile having an inner surface, an outer surface and a top edge, the second profile including at least one closure element positioned along the length of the inner surface, the closure element of the second profile adapted to interlock with the closure element of the first profile. The third element consists of a plurality of alternating deformed and undeformed segments disposed along the length of at least one of the profiles. The fourth element is a slider straddling the profiles adapted to open and close the bag as the slider is moved across the profiles. The alternating deformed and undeformed segments can be disposed along at least one of the closure elements of at least one of the profiles, along the top edge of at least one of the profiles, or along the outer surface of at least one of the profiles. The alternating deformed and undeformed segments are adapted to provide an intermittent tactile or audible sensation as the closure elements engage or as the slider contacts the deformed and undeformed segments.

DETAILED DESCRIPTION OF THE INVENTION

Figure 1:
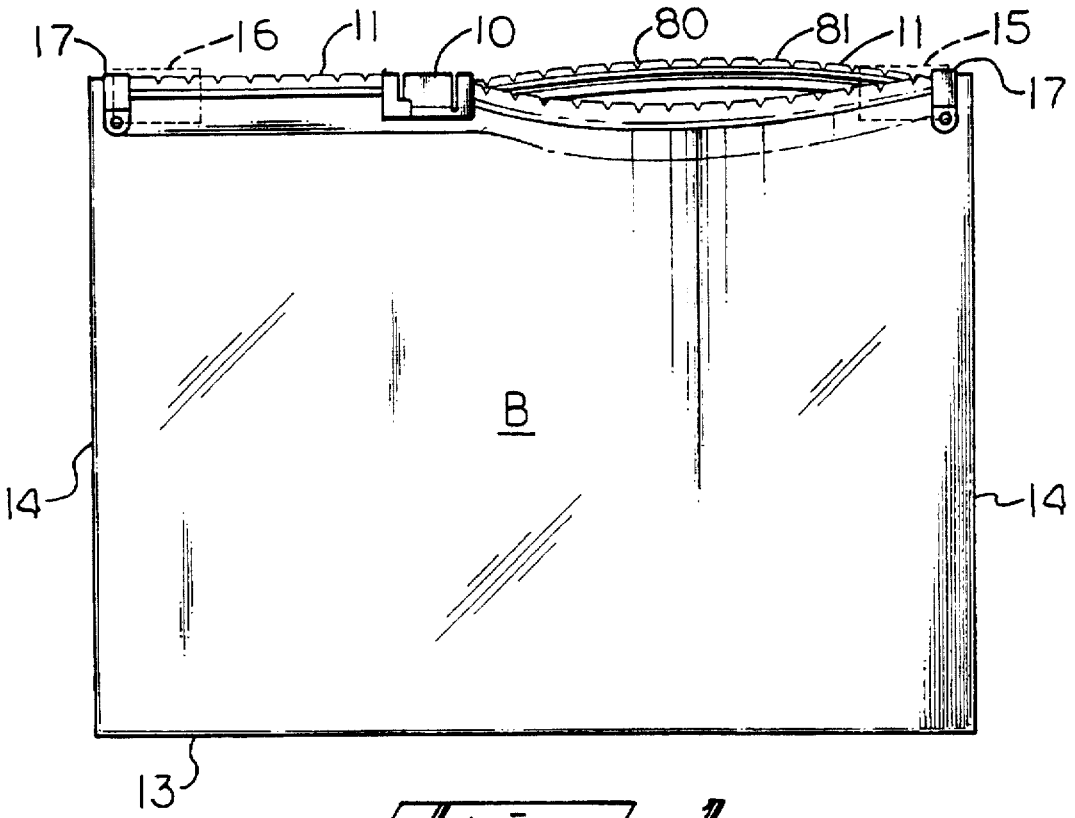
FIG. 1 is a front view of a thermoplastic bag with a plastic reclosable fastener of the present invention.

FIG. 1 illustrates a reclosable thermoplastic bag B having a profiled plastic reclosable fastener 11 with alternating deformed and undeformed segments, and a slider 10 straddling the reclosable fastener, embodying the present invention. The alternating deformed and undeformed segments provide tactile and/or audible feedback to a user of the bag when the user moves the slider 10 between an open position 16 and a closed position 15.

Bag B also has a sealed bottom 13 and two opposing sealed edges 14. Bag B may be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one of these polymers with another thermoplastic polymer. Additives such as pigments and ethylene vinyl acetate (EVA) can be added, if desired.

Figure 2:
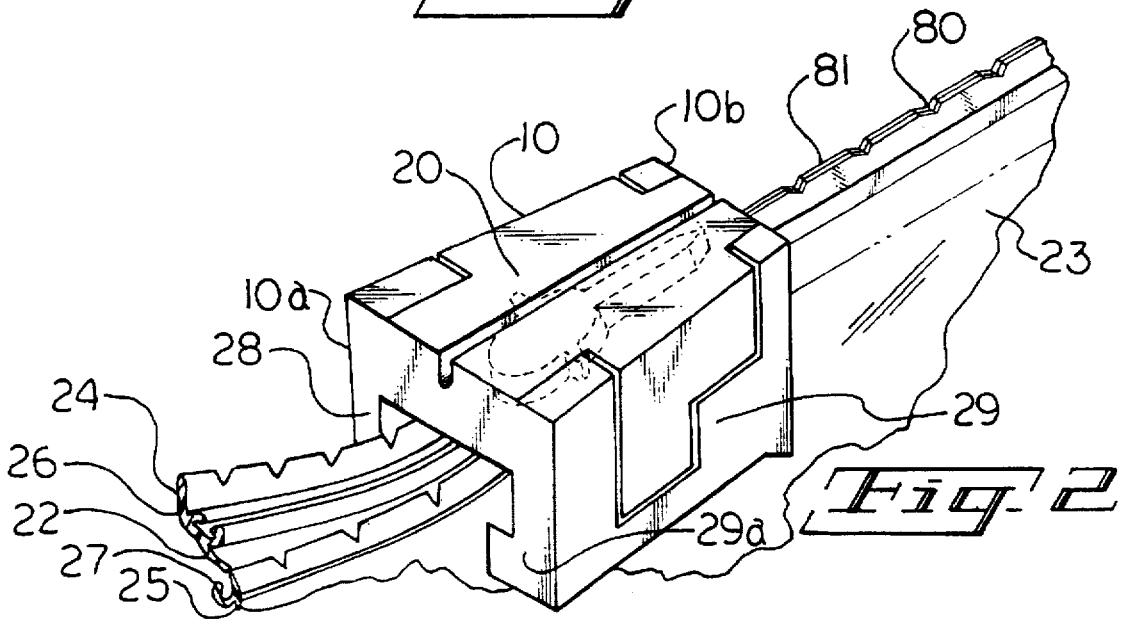
FIG. 2 is a perspective view of a portion of a bag having notches in the top edge of the profile with a slider.

Referring now to FIG. 2, the bag B comprises a pair of flexible plastic sheets 22 and 23. The sheet 22 has a top edge having a first profile 24 attached thereto. The first profile 24 has an inner surface, a top edge, and an outer surface on the outside of the bag. The sheet 23 has a top edge having a second profile 25 attached thereto. The second profile 25 has an inner surface, a top edge, and an outer surface on the outside of the bag. The profiles 24 and 25 may be extruded separately and attached to the respective sides of the bag or the profiles 24 and 25 may be extruded integrally with the sides of the bag.

First profile 24 includes at least one closure element 26 which extends along the inner surface of the first profile 24. Second profile 25 also includes at least one closure element 27 which extends along the inner surface of the second profile 24. When the bag is closed, the closure element 26 of the first profile 24 interlocks with the closure element 27 of the second profile 25, so that the closure elements remain interlocked throughout substantially their entire length when the bag is closed, thereby forming a seal. The seal advantageously is such that under normal conditions of use, it forms a barrier to liquids.

Figure 3:
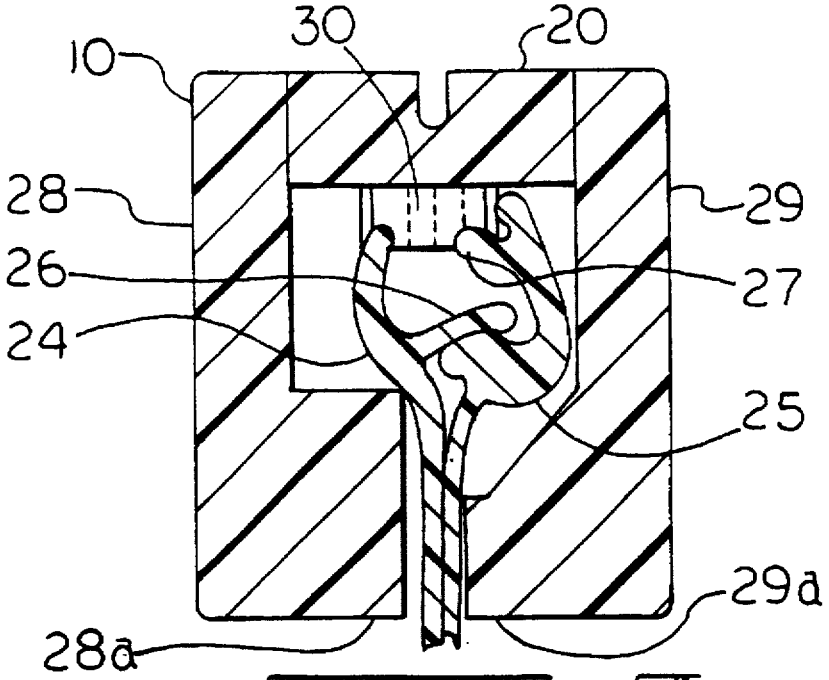
FIG. 3 is a sectional view of a rib and groove profile with a slider.
Figure 4:
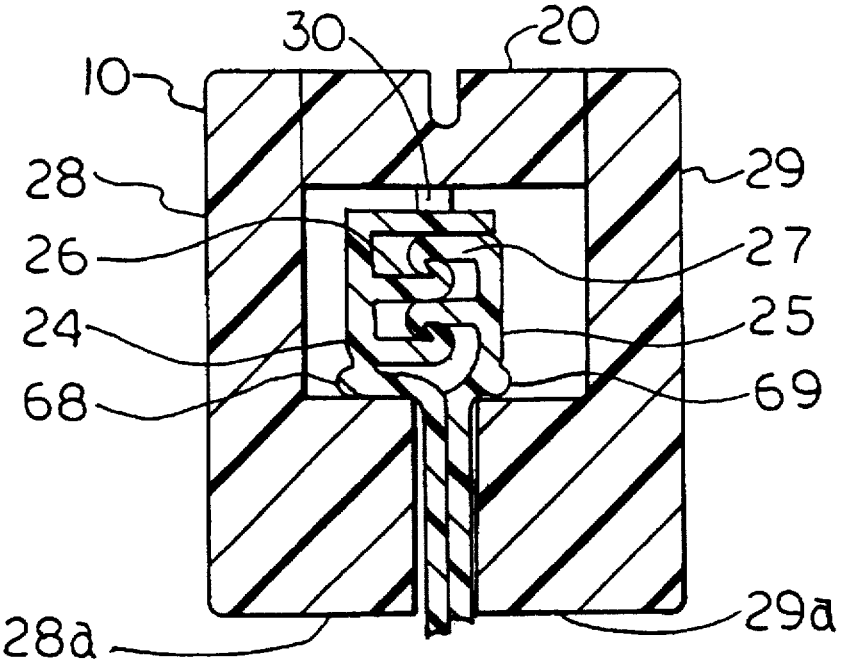
FIG. 4 is a sectional view of an alternating hook-shaped profile with a slider.

Closure elements 26 and 27 can be any shape. For example, the closure elements can have a rib and groove shape with a rolling action interlocking mechanism, as shown in FIG. 3 and as described in U.S. Pat. No. 5,007,143. Alternatively, the closure elements can have an alternating hook shape, as shown in FIG. 4 and as described in U.S. Pat. No. 3,173,184. The profiles can have any other desired shape as well. Closure elements 26 and 27 are closed by pressing the profiles together. The pressing action is accomplished by a pinching end 10*b* of the slider 10.

When the bag B is open, profiles 24 and 25 are separated from each other as are closure elements 26 and 27 on the respective profiles. The separating action is accomplished by features included in a separating end 10*a* of the slider 10, as described below.

Referring again to FIG. 1, the slider 10 moves between a closed position 15 and an open position 16. Thus, when the slider 10 reaches the closed position 15 at one end of the profiles, the bag is closed, and the closure elements are interlocked throughout substantially their entire length. When the slider reaches the open position 16 at the opposite end of the profiles, the bag is open and the closure elements are disengaged throughout substantially their entire length.

The fastener assembly of the present invention provides a tactile and/or audible sensation in addition to visual feedback to the user of the bag as the user moves the slider across the bag. The tactile/audible sensation results from alternating deformed and undeformed segments which are disposed along the inner surface, the top edge, or the outer surface of at least one of the profiles 24 or 25.

Figure 5A:
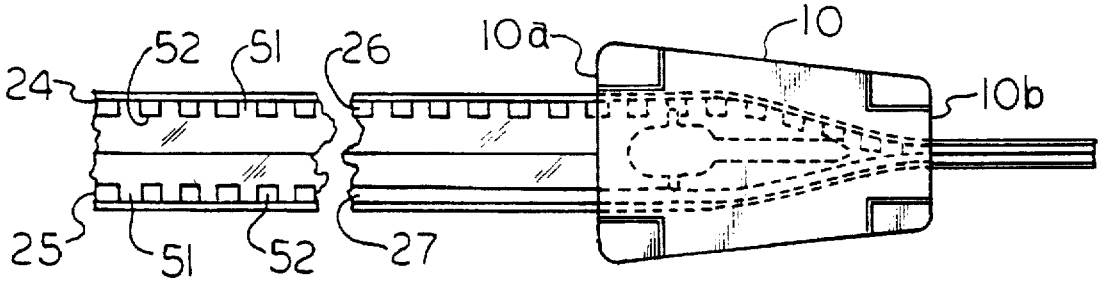
FIGS. 5A, 5B and 5C are top views of embodiments of profiles having alternating deformed and undeformed segments along the inner surfaces of the profiles.
Figure 5B:
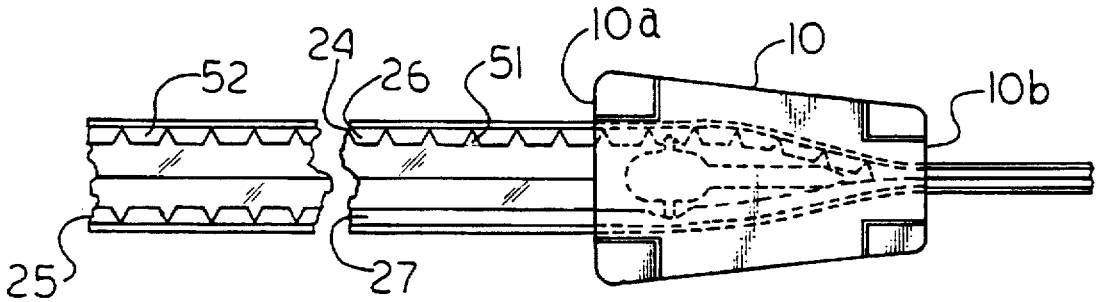
Figure 5C:
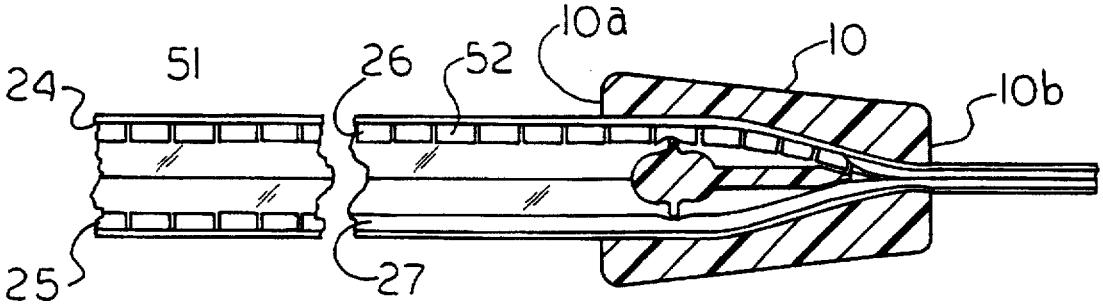

Referring now to FIGS. 5A, 5B and 5C, therein are shown embodiments of the present invention wherein the deformed segments 51 and undeformed segments 52 are disposed along the inner surface of at least one of the profiles 24 and/or 25. More particularly, segments 51 and 52 are disposed along at least one of the closure elements 26 and/or 27 which are positioned along the inner surfaces of the profiles 24 and 25. The deformations in the closure elements create a bumpy surface, so that the closure elements interlock in an inconsistent manner. The result is a tactile sensation, which means the user perceives a bumpy feeling as the user moves the slider across the profiles. The result can also be an audible sensation, which means the user hears a clicking sound as the user moves the slider across the profiles. Furthermore, the result can be visual feedback, as the deformations can be hidden when the closure elements are interlocked, whereas the deformations can be visible when the closure elements are not interlocked.

The deformed segments 51 positioned along the closure elements can take on various forms, including rectangular or V-shaped notches, slits, contrasting contours, or any irregular shape that provides a tactile and/or audible sensation. As shown in FIG. 5A, the deformed segments 51 can be rectangularly-shaped notches cut out of the inner surface of the profiles. The notches can be cut out of both profiles 24 and 25, as shown, or the notches can be cut out of just one of the profiles 24, as is also shown. As shown in FIG. 5B, deformed segments 51 can be V-shaped notches cut out of the inner surface of the profiles. As shown in FIG. 5C, deformed segments 51 can be slits cut out of the inner surface of the profiles.

The term "deformed" is not used herein to imply a method of manufacture by which an "undeformed" segment is deformed in a subsequent manufacturing step. Instead, the terms "deformed" and "undeformed" are used to make clear that the geometries of the two types of segments contrast.

Figure 6A:
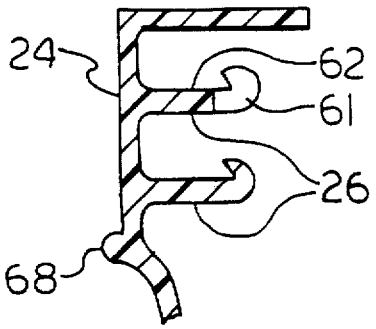
FIGS. 6A and 6B are sectional views of rib and groove profiles having alternating deformed segments and undeformed segments.
Figure 6B:
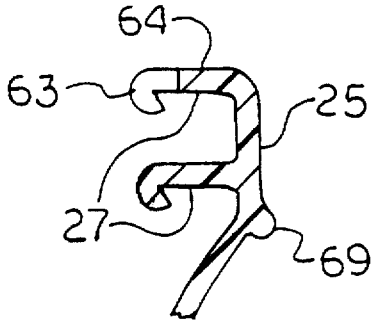

Furthermore, as shown in FIGS. 6A and 6B, the closure elements 26 and 27 can have an alternating hook shape, and the deformed segments can be notches or slits cut out of at least one of the profiles 24 and/or 25. FIG. 6A shows undeformed, or unnotched segments 61, projecting from the inner surface of the profile 24 beyond deformed, or notched segment 62. FIG. 6B shows undeformed or unnotched segments 63 projecting from the inner surface of profile 25 beyond deformed, or notched segment 64. Deformed segments which are notches or slits can be formed by, for example, cutting the closure elements with a knife, or by using heat and/or pressure to deform the profiles. The notches or slits can be formed before or after attaching the profiles to the bag.

Figure 7A:
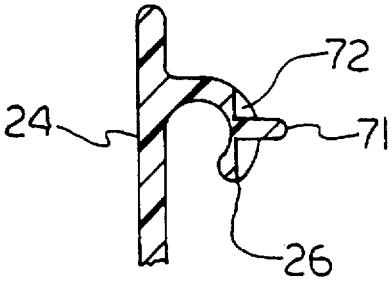
FIGS. 7A and 7B are sectional views of an alternating hook shaped profile having alternating deformed and undeformed segments.
Figure 7B:
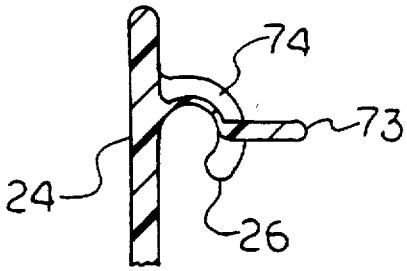

Alternatively, instead of notches or slits, the deformed segments can be sections of at least one of the closure elements with a contour that varies from the contour of the undeformed segments. For example, as shown in FIG. 7A, the deformed segments can include a section 71 that is taller and narrower than the undeformed segments 72. FIG. 7B also shows a deformed segment 73 which is taller and narrower than undeformed segment 74. The deformed segments can be shorter and wider than the undeformed segments, if desired. The varied contours can be formed, for example, by mashing at least one of the closure elements in alternating segments, by squeezing at least one of the closure elements in alternating segments, or by applying heat in alternating segments.

Optionally, as shown in FIG. 6A, a flange 67 can be disposed along the top edge of the first profile. The flange 67 extends perpendicularly from the top edge, so that when the closure elements are pressed into engagement, the flange covers the interlocked closure elements. Preferably, in the embodiment shown in FIGS. 6A and 6B, the alternating deformed and undeformed segments are disposed at least along the uppermost closure element of the second profile 25, as shown in FIG. 6B. In this embodiment, when the closure elements are pressed into engagement, the flange 67 covers the alternating deformed and undeformed segments 63 and 64, thereby hiding the deformations. Thus, not only does the fastener assembly provide tactile and/or audible feedback to the user as the slider moves across the profiles, but the fastener assembly can provide visual feedback as well.

Figure 8A:
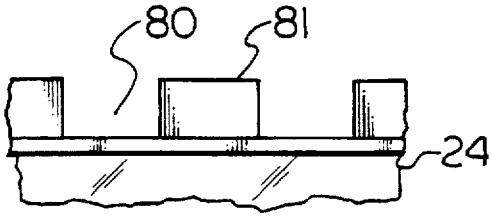
FIGS. 8A and 8B are side views showing a portion of the fastener having deformed segments in the top edges of the profiles.
Figure 8B:
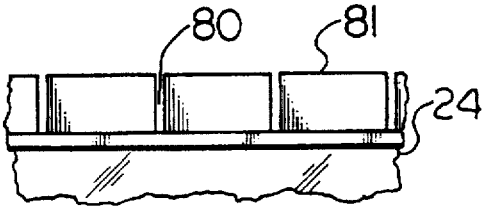

Rather than being positioned along the inner surface, the alternating deformed and undeformed segments can be positioned along the top edge of at least one of the profiles. Referring again to FIGS. 1 and 2, therein is shown a series of deformed segments 80 alternating with undeformed segments 81. The deformed segments 80 can be, for example, V-shaped notches, as shown in FIGS. 1 and 2, rectangular notches, as shown in FIG. 8A, or slits, as shown in FIG. 8B, or the deformed segments can have any irregular shape which provides a tactile and/or audible sensation. The notches or slits along the top edge can be formed by cutting the top edge with a knife, or by any other desired method.

Figure 10A:
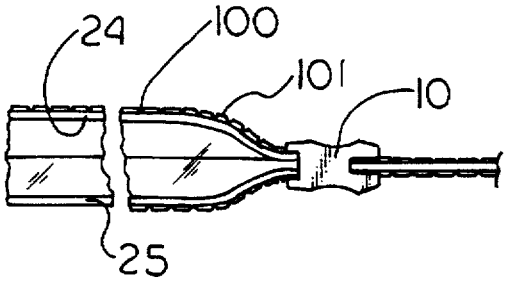
FIGS. 10A and 10B are top and side views, respectively, of a profile having alternating deformed and undeformed segments along the outer surface thereof.
Figure 10B:
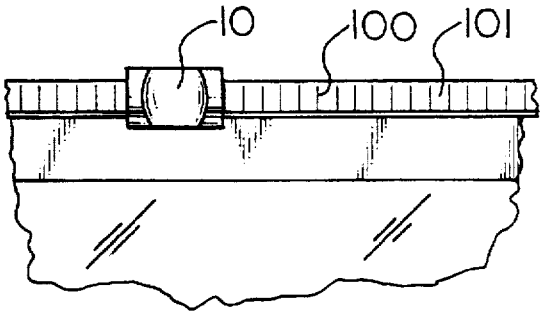

Rather than being positioned along the inner surface or the top edge, the deformed and undeformed segments can be positioned along the outer surface of at least one of the profiles. Referring now to FIGS. 10A and 10B, therein are shown a series of deformed segments 100 alternating with undeformed segments 101. The deformed and undeformed segments can be disposed along the outer surface of just one of the profiles, as shown, or the deformed and undeformed segments can be disposed along the outer surface of both profiles, as is also shown. The deformed segments can have various forms, including, for example, depressions or dimples, rectangular or V-shaped notches, slits, or any other irregular shape that provides a tactile and/or audible sensation. The deformed segments can be disposed directly along the surface of the outer edge of the profiles, or the deformed segments can be positioned along an external ridge affixed along the outer edge of at least one of the profiles.

Referring now to FIGS. 6A and 6B, therein is shown an alternating hook profile having an external ridge 68 along the outside surface of the first profile 24 and a ridge 69 along the outside surface of the second profile 25. The ridge 68 and/or 69 can be notched or have slits cut out of it. The notches or slits create a bumpy surface along the ridge 68 and/or 69. As the slider 10 moves along the profiles, the slider contacts the bumpy surface of the ridge, producing a tactile/audible sensation.

Depressions or dimples along the outer surface can be formed by, for example, applying pressure to the profiles in alternating positions. Notches or slits can be formed by cutting the outer edge with a knife, or by any other desired method. Ridges 68 and/or 69 can be attached to the fastener strips by any desired means, such as, for example, extruding them together with the fastener strips, heating, gluing, or snapping them into place.

Referring again to FIG. 2, the straddling slider 10 comprises an inverted U-shaped member having a top 20 for moving along the top edges of the profiles 24 and 25. The slider 10 has side walls 28 and 29 depending from the top 20. Side walls 28 and 29 extend downward along the outer surface of the profiles 24 and 25, such that at least a portion of the closure elements 26 and 27 are held between the side walls 28 and 29. Side walls 28 and 29 cooperate with the profiles 24 and 25 such that, as the slider moves between the open and closed position, profiles 24 and 25 are received between the side walls 28 and 29.

Figure 9A:
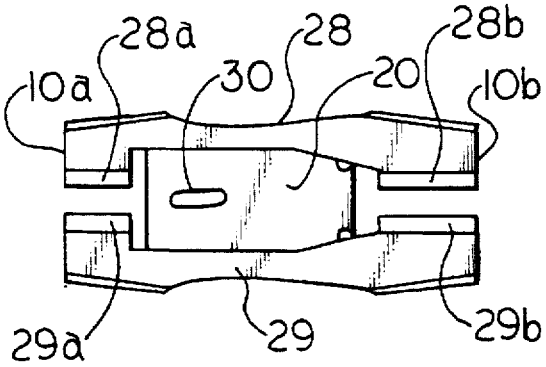
FIGS. 9A and 9B are bottom and cross sectional side views of a slide of the present invention, respectively.
Figure 9B:
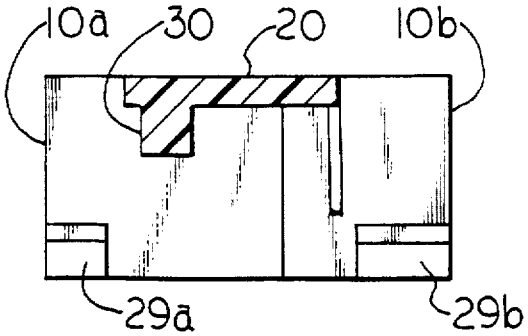

As shown in FIGS. 9A and 9B, side walls 28 and 29 extend from a separating end **10*a* of the slider to a pinching end 10*b* of the slider. The side walls 28 and 29 are spaced farther apart at the separating end 10*a* than at the pinching end 10*b*. The closer spacing at the pinching end 10*b* acts to pinch, or squeeze the fastening strips together, thereby forcing the closure elements 26 and 27** into an interlocked relationship. The profiles can be squeezed together all at once, or the profiles can be interlocked by a rolling action, as described in U.S. Pat. No. 5,007,143.

As shown in FIGS. 9A and 9B, a separating element 30 optionally depends from the top 20 between the side walls 28 and 29 and is inserted between the profiles 26 and 27. The separating element can extend down all the way through the profiles, partially through the profiles, or the separating element can slide along the top of the profiles. As shown, the separating element 30 is positioned in about the middle of the top 20 of slider 10, although the separating element can be positioned anywhere along the top.

When the slider 10 is moved toward the open position 16, the pinching end **10*b* of the slider leads, and the separating end 10*a* of the slider trails, so that the separating element 30 disengages the profiles 26 and 27. When the slider 10 is moved toward the closed position 15, the separating end 10*a* leads and the pinching end 10*b* trails, so that the pinching end 10*b*** squeezes the profiles together into engagement.

In one embodiment of the present invention, the slider further comprises a flapper adapted to flex as the flapper contacts the notches. The flapper can depend from the top of the slider, from the separating element, or from at least one of the side walls of the slider. The flapper can be designed such that the flapper bends in a hinge-like manner from its original position when the slider passes over an undeformed segment, or an unnotched section of the profile. Preferably, the flapper is designed such that the flapper "snaps" back into its original position when the slider passes over a notched or deformed segment. The flapper thus enhances the tactile and/or audible sensation to the user.

The position of the flapper depends upon the position of the alternating deformed and undeformed segments. Thus, if the alternating deformed and undeformed segments are positioned along the closure elements, the flapper is preferably positioned on the separating element of the slider, so that the flapper contacts the alternating deformed and undeformed segments. If the alternating deformed and undeformed segments are positioned along the top edge of the profiles, then the flapper should be positioned either on the top of the slider or on the separating element of the slider, so that the flapper contacts the alternating deformed and undeformed segments. If the alternating deformed and undeformed segments are positioned on the outside edge of the profiles, then the flapper should be positioned on at least one of the side walls so that the flapper contacts the alternating deformed and undeformed segments.

The fastening assembly preferably includes means for maintaining the slider in straddling relation with the fastening strips. In the embodiment shown in FIGS. 2–3, the means includes shoulders **28*a*, 29*a*, 28*b* and 29*b* on the side walls of the slider. Shoulders 28*a* and 29*a* project inwardly from the depending side walls at the separating end 10*a* of the slider. As shown, the slider also has shoulders 28*b* and 29*b* projecting inwardly from the depending side walls at the pinching end 10*b* of the slider. Preferably, shoulders 28*a*, 29*a*, 28*b* and 29*b* project inwardly at a point at or below the profiles 26 and 27. The shoulders act as means for maintaining the slider in straddling relation with the fastening strips by grasping the lower surfaces of the outside edges of profiles 26 and 27. The outer surfaces thus act as handles for the slider to hold onto, such that the slider 10 maintains the straddling relation with the fastening strips and does not fall off the bag. The shoulders can be continuous along the entire length of the slider, if desired, in order to maximize the security to the bag. Furthermore, as shown in FIG. 4, ridges 68 and/or 69, positioned along the outer surface of the fastener strips, can cooperate with the shoulders 28*a*, 28*b*, 29*a* and 29*b*** of the slider in order to enhance the security of the slider on the bag.

The slider 10 may be made in multiple parts and welded together or the parts may be constructed to be snapped together. The slider 10 may also be of one piece construction. The slider can be made using any desired method, such as, for example, injection molding. The slider can be molded from any suitable plastic such, for example, as nylon, polypropylene, polystyrene, acetal, toughened acetal, polyketone, polybutylene terephthalate, high density polyethylene, polycarbonate, or ABS. The slider can be clear, opaque, or colored.

The slider 10 can be attached to the bag by any desirable method. For example, the slider can be attached to the bag by snapping together a multi-part slider, as described in U.S. Pat. No. 5,007,142 or by folding a foldable slider as described in U.S. Pat. No. 5,010,627. The slider may also be attached to the bag by cutting the profiles and inserting the slider over the cut ends, as described in U.S. Pat. No. 5,431,760. The slider can also be attached to the bag by the use of a tool which separates the walls of the slider so that the slider can fit over the profiles, as described in U.S. Pat. No. 4,262,395.

A bag incorporating the fastener and slider of the present invention preferably includes means for preventing the slider from sliding off the end of the bag once the slider reaches the closed position 15 or open position 16. Such means for preventing the slider from sliding off the end of the bag preferably includes end stops such as end stops 17 shown in FIG. 1. End stops 17 perform the dual function of stops for the ends of the fastener 11 to prevent the slider 10 from going off past the end of the fastener 11 and they also hold the two profiles 26 and 27 together to prevent the bag from opening in response to stresses applied to the profiles through normal use of the bag. The end stops 17 also provide a convenient finger grip for the user when moving the slider 10.

Examples of end stops include riveted end clamps as described in U.S. Pat. Nos. 5,067,208 and 5,161,286, transverse end stops made from molten material for the profiles, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807. Alternatively, the end stops can be sections of the profiles that are fused together proximate to the open and closed positions, such that the end stops are raised. Such raised end stops can be formed by, for example, heating, applying pressure, or using ultrasonic methods.

The fastening assembly of the present invention optionally includes means for retaining the slider in the closed position so that a bag incorporating the zipper and slider of the present invention does not inadvertently open. For example, the means for retaining the slider in closed position can comprise a "parking spot" such as that disclosed in U.S. Pat. No. 5,067,208, or a "parking spot" with diverging ends such as that disclosed in U.S. Pat. No. 5,301,395. In yet another alternative, the means for retaining the slider in closed position can comprise a latching means, such as a detent on the slider together with a protrusion on the zipper as disclosed in U.S. Pat. No. 5,189,764.

The bag of the present invention can be made using methods well known in the art, such as, for example, by blow or cast extrusion. The slider can be attached to the fastener strips using various methods. For example, the slider can be attached to the bag by using a tool to produce reciprocal movements of the slider, as described in U.S. Pat. No. 4,262,395. Alternatively, the slider can be attached to the bag through a hinge structure which attaches wings to the body of the slider, as described in U.S. Pat. No. 5,067,208, or through a rigidizing structure as described in U.S. Pat. No. 5,283,932. The slider can also be attached to the bag through in-place assembly.

While several embodiments of the invention have been described and illustrated, it is to be understood that further modifications thereof may be made within the scope of the appended claims without departing from the spirit of the invention.

What is claimed is:

1. A reclosable fastener assembly for closing and opening a thermoplastic bag, comprising:

a) a first profile having an inner surface, an outer surface, and a top edge, the first profile including at least one closure element positioned along the length of the inner surface;

b) a second profile having an inner surface, an outer surface and a top edge, the second profile including at least one closure element positioned along the length of the inner surface, the closure element of the second profile adapted to interlock with the closure element of the first profile, the inner surfaces of the first and second profiles being disposed between the outer surfaces of the first and second profiles;

c) a plurality of alternating deformed and undeformed segments disposed along the length of the outer surface of at least one of the profiles; and d) a slider straddling the profiles adapted to interlock and disengage the closure elements as the slider is moved across the profiles;

wherein the alternating deformed and undeformed segments are adapted to provide a tactile sensation, an audible sensation, or a combination thereof as the slider moves across the profiles.

2. The fastener assembly of claim 1 wherein the deformed segments are rectangular notches, V-shaped notches or slits.

3. A reclosable fastener assembly for closing and opening a thermoplastic bag, comprising:

a) a first profile having an inner surface, an outer surface, and a top edge, the first profile including at least one closure element positioned along the length of the inner surface;

b) a second profile having an inner surface, an outer surface and a top edge, the second profile including at least one closure element positioned along the length of the inner surface, the closure element of the second profile adapted to interlock with the closure element of the first profile;

c) a plurality of alternating deformed and undeformed segments disposed along the length of the closure element of at least one of the profiles, the deformed segments being taller and narrower sections of the closure element than the undeformed segments; and d) a slider straddling the profiles adapted to interlock and disengage the closure elements as the slider is moved across the profiles;

wherein the alternating deformed and undeformed segments are adapted to provide a tactile sensation, an audible sensation, or a combination thereof as the slider moves across the profiles.

4. The fastener structure of claim 1 wherein at least one of the profiles is colored.

5. The fastener assembly of claim 1, wherein the fastener assembly further comprises:

a flange disposed along the top edge of the first profile, the flange extending perpendicularly from the top edge, the flange adapted to cover at least the uppermost closure element of the second profile when the fastener assembly is closed.

6. A reclosable fastener assembly for closing and opening a thermoplastic bag, comprising:

a) a first profile having an inner surface, an outer surface, and a top edge, the first profile including at least one closure element positioned along the length of the inner surface;

b) a second profile having an inner surface, an outer surface and a top edge, the second profile including at least one closure element positioned along the length of the inner surface, the closure element of the second profile adapted to interlock with the closure element of the first profile;

c) a plurality of alternating deformed and undeformed segments disposed along the length of the top edge of at least one of the profiles; and d) a slider straddling the profiles adapted to interlock and disengage the closure elements as the slider is moved across the profiles;

wherein the alternating deformed and undeformed segments are adapted to provide a tactile sensation, an audible sensation, or a combination thereof as the slider moves across the profiles.

7. The fastener assembly of claim 6 wherein the deformed segments are rectangular notches, V-shaped notches or slits.

8. The fastener assembly of claim 7, wherein the slider comprises a flapper adapted to flex as the flapper contacts the notches.

9. The fastener assembly of claim 1 wherein the deformed segments are depressions.

10. The fastener assembly of claim 9 wherein at least one of the profiles is colored.

11. The fastener assembly of claim 1, further comprising:

e) a ridge disposed along the length of the outer surface of at least one of the profiles.

12. The fastener assembly of claim 11, wherein the plurality of alternating deformed and undeformed segments are disposed along the length of the ridge.

13. The fastener assembly of claim 12 wherein the deformed segments are rectangular notches, V-shaped notches or slits.

14. The fastener assembly of claim 13, wherein at least one of the profiles is colored.

* * * * *